US007386962B2

(12) United States Patent
Estes et al.

(10) Patent No.: US 7,386,962 B2
(45) Date of Patent: Jun. 17, 2008

(54) BATTEN RISER ASSEMBLY

(75) Inventors: Timothy R. Estes, Parker, CO (US); Lars J. Walberg, Eagle, CO (US)

(73) Assignee: L & T Riser LLC, Commerce City, CO (US)

( * ) Notice: Subject to any disclaimer, the term of this patent is extended or adjusted under 35 U.S.C. 154(b) by 115 days.

(21) Appl. No.: 11/265,976

(22) Filed: Nov. 2, 2005

(65) Prior Publication Data

US 2006/0117695 A1 Jun. 8, 2006

Related U.S. Application Data

(63) Continuation-in-part of application No. 11/072,810, filed on Mar. 4, 2005.

(60) Provisional application No. 60/550,958, filed on Mar. 5, 2004.

(51) Int. Cl.
*E04D 1/34* (2006.01)
*E04B 1/70* (2006.01)

(52) U.S. Cl. ..... 52/553; 52/302.1

(58) Field of Classification Search ..... 52/551, 52/549, 550, 748.1, 302.1, 553; 211/94.01, 211/106, 113, 87.01, 106.01
See application file for complete search history.

(56) References Cited

U.S. PATENT DOCUMENTS 1,163,034 A 12/1915 Phippen
2,361,112 A * 10/1944 Llewellyn ..... 52/478
2,862,255 A 12/1958 Nelson
3,253,375 A 5/1966 Takehara
3,984,958 A 10/1976 Murray
4,007,571 A 2/1977 Marchello et al.
4,170,859 A 10/1979 Counihan
4,219,981 A 9/1980 Stewart et al.
4,233,793 A 11/1980 Omholt
4,288,951 A * 9/1981 Carlson et al. ..... 52/94
4,788,801 A 12/1988 Jones (Continued)

FOREIGN PATENT DOCUMENTS

CH 375895 A1 * 7/1990 ..... 211/113

(Continued)

OTHER PUBLICATIONS

Roof Tile Institute; Concrete and Clay Roof Tile Design Criteria Installation Manual for Moderate Climate Regions; Sep. 2002; USA; pp. 1-73.

*Primary Examiner*—Richard Chilcot
*Assistant Examiner*—Adriana Figueroa
(74) *Attorney, Agent, or Firm*—William W. Cochran; Cochran Freund & Young LLC

(57) ABSTRACT

Disclosed is a batten riser assembly that is used to install battens for tile roofs. The batten riser assembly can be used to prolong the life of tile roofs since it is made of waterproof materials. The batten riser assembly uses flexible strips that can be easily folded in a compact package and can be installed in a quick and easy manner. The batten riser assembly can be used in conjunction with a marker tape to speed installation. The batten riser assembly is designed to prevent the damming of water that penetrates the tile roof. The batten riser assembly provides a simple and easy way for installers to comply with building codes.

19 Claims, 13 Drawing Sheets

U.S. PATENT DOCUMENTS

| | | | | | |
|---|---|---|---|---|---|
| 4,958,471 | A | | 9/1990 | Waddington | |
| 5,005,330 | A | | 4/1991 | Todisco | |
| 5,197,252 | A | | 3/1993 | Tiscareno | |
| 5,412,917 | A | | 5/1995 | Shelton | |
| 5,425,908 | A | | 6/1995 | Merser | |
| 5,471,807 | A | * | 12/1995 | Vasquez | 52/553 |
| 5,531,166 | A | | 7/1996 | Woods et al. | |
| 5,642,596 | A | | 7/1997 | Waddington | |
| 5,711,116 | A | | 1/1998 | Hasan | |
| 6,189,274 | B1 | | 2/2001 | Ollikainen | |
| 6,266,937 | B1 | | 7/2001 | Watanabe | |
| 6,357,193 | B1 | | 3/2002 | Morris | |
| 6,393,796 | B1 | | 5/2002 | Goettl et al. | |
| 6,511,741 | B1 | | 1/2003 | Hungarter | |
| 6,536,171 | B1 | * | 3/2003 | Vandewater | 52/302.1 |
| 6,560,945 | B1 | | 5/2003 | Carpenter | |
| 6,718,719 | B1 | * | 4/2004 | Hagerty | 52/553 |
| 6,764,260 | B1 | | 7/2004 | Nebesnak et al. | |
| 7,067,952 | B2 | * | 6/2006 | Neal | 310/259 |
| 2003/0172606 | A1 | | 9/2003 | Anderson | |
| 2004/0187434 | A1 | | 9/2004 | Podirsky | |
| 2004/0237455 | A1 | | 12/2004 | Chen | |
| 2005/0000172 | A1 | | 1/2005 | Anderson | |

FOREIGN PATENT DOCUMENTS

| | | | | | |
|---|---|---|---|---|---|
| CH | WO375895 | A1 | * | 7/1990 | 211/113 |
| SE | WO 83/ 01477 | | * | 4/1983 | 52/551 |
| WO | WO 83/01477 | | | 4/1983 | |
| WO | WO 96/27718 | | | 9/1996 | |
| WO | WO 00/49245 | | | 8/2000 | |
| WO | WO 00/66853 | | | 11/2000 | |

* cited by examiner

BATTEN RISER ASSEMBLY

CROSS-REFERENCE TO RELATED APPLICATIONS

This application is a continuation-in-part of Ser. No. 11/072,810 entitled "Batten Riser System" by Lars J. Walberg and Timothy R. Estes filed Mar. 4, 2005, and is based upon Ser. No. 60/550,958 entitled "Batten Riser System" by Kurt Walberg and Lars Walberg filed Mar. 5, 2004 and Ser. No. 60/683,544 entitled "Batten Riser System" by Timothy R. Estes and Lars J. Walberg filed May 20, 2005. The entire contents of the above mentioned applications are hereby specifically incorporated herein by reference for all they disclose and teach.

BACKGROUND OF THE INVENTION a. Field of the Invention

The present invention pertains generally to roofing systems and more particularly to batten systems for tile roofs.

b. Description of the Background

Tile roofs provide an effective form of roofing that is long lasting, if installed properly, fire resistant and can have an aesthetic appearance. Tiles can be made of various different materials including fiberglass, cement, clay and other materials, all of which are generically referred to herein as "tiles". For some time, tiles have been installed over plywood or oriented strand board (OSB) roof decking which is covered by an underlayment and regularly spaced battens, which are fastened through the underlayment to the roof deck. The tiles are then hung from and fastened to the roof battens. If precipitation penetrates the tile, the battens have a potential to dam water resulting in leakage of water through the penetrations of the underlayment as a result of fastening the battens to the roof deck and potential rotting of the battens that are placed in horizontal orientation, the dam water. This substantially threatens the lifespan of the roof.

As a solution to these problems, roofers adopted a lath and batten system, i.e., a counter-batten system in which vertically oriented battens are nailed to a felt covered roof with spacings of anywhere from 16 to 24 inches and horizontally oriented battens are nailed to the vertically oriented battens at spacings that satisfy the overlap dimensions of the tiles. These types of counter-batten systems allow water that seeps through the tiles to flow along the felt and not be dammed by horizontally oriented battens that are nailed directly to the roof. In other words, this type of counter-batten system allowed the free flow of water that penetrates the tiles along the underlayment without being substantially, impeded. In addition, the counter-batten systems create an airspace that provides insulating qualities and mediates the transmission of heat to and from the roof tile. As such, the heat transferred between the roof and the rest of the structure is mediated. In climates where snow can accumulate on the roof surface, this effect reduces the severity of the freeze/thaw cycles that occur on a roof, which can result in damming of water.

However, installation of these types of systems is labor intensive and time consuming. In addition, the spacing of the vertically oriented battens is normally controlled by local building codes. In order to reduce the amount of material used, installers typically install the vertical battens at the maximum width allowed by the building code. This requires careful measuring to ensure that the spacing of the vertically oriented battens does not exceed the maximum spacing allowed by code. If these measurements are not carefully made, the spacing of the vertically oriented battens can exceed the maximum spacing allowed which can, in some instances, result in the building inspector requiring that the roof be removed and reinstalled in accordance with code. Shims can be used to also reduce material costs. However, the same problems are involved with the installation of shims at distances that do not exceed code requirements.

In addition, wooden battens and shims are susceptible to rot in the moist environment of the roof system. As a result, the entire roof system must be replaced periodically because the counter-batten system tends to rot as a result of the naturally moist environment under the tiles. The vertically oriented battens in a counter-batten system and the shims in a shim system are both directly nailed to the felt on the roof and have constant contact with water that flows along the felt. As a result, the vertically oriented battens, in a counter-batten system, and the shims, in a shim system, do not have an extended life cycle.

In addition to the careful measurements that must be made when installing the vertically oriented batten systems, even more precise measurements must be made when installing the horizontal battens. After the proper spacing of horizontal battens is determined at each edge of the roof, a snap line must be used to mark the proper location of the horizontal battens, considering the allowable overlap of the tile. Few battens are straight enough and long enough to individually span the horizontal distance of the roof. Once the chalk snap lines have been placed on the roof, the horizontal battens can be installed. For example, a 14 inch spacing between horizontally oriented battens is typically a suitable spacing for most tiles. This process is a time consuming and labor intensive process that increases the expense of installation of tile roof systems.

SUMMARY OF THE INVENTION

The present invention overcomes the disadvantages and limitations of the prior art by providing a riser system for attachment of battens.

The present invention may therefore comprise a batten riser system for attaching battens to a roof comprising: at least one flexible strip; and, a plurality of risers attached to the flexible strip, the risers constructed from a substantially waterproof material comprising: at least one flange for mechanically attaching the riser to a roof deck; a raised body portion that provides a gap between the battens and the roof deck.

The present invention may further comprise of a method of making a batten riser assembly comprising: providing a plurality of risers that are made from a substantially waterproof material, the risers having at least one flange portion on each riser of the plurality of risers for attaching the riser to a roof surface, the riser having a raised body portion for supporting battens so that a gap is formed between the battens and the roof surface; attaching at least one flexible strip to the plurality of risers, the flexible strip being substantially waterproof and straight when extended in a lengthwise direction for aligning the batten riser assembly on the roof surface, the flexible strip being made from a material that has a lateral strength that is sufficient to substantially minimize stretching along the length of the strip so as to provide spacing of the plurality of risers by a predetermined distance that meets building code requirements.

The present invention may further comprise a method of installing a batten riser assembly on a roof deck comprising: placing at least two marker tapes on the roof deck; aligning markings on the marker tape with the roof deck; providing a plurality of batten riser assemblies, each batten riser assembly of the plurality of batten riser assemblies comprising a plurality of risers that are substantially waterproof and that have flanges for attaching the plurality of risers to the roof deck, the plurality of risers having a raised body portion, at least one flexible strip that is attached to the plurality of risers so that the risers are spaced apart by a predetermined distance, the flexible strip being substantially waterproof and straight when extended in a lengthwise direction and having sufficient strength to minimize stretching in a lengthwise direction; extending the batten riser assembly on the roof deck over the marker tape so that the flexible strip is extended to form a substantially straight line; aligning the flexible strip with the markings on the marker tape; and attaching the plurality of batten riser assemblies to the roof deck.

The present invention may further comprise a roof batten riser system for attachment to a roof supporting surface and for receiving elongate batten strips, the batten riser system comprising: elongate collapsible spacer elements that have opposing first and second surfaces such that a first surface of the opposing surfaces of the elongate collapsible spacer elements faces the roof supporting surface when installed on the roof supporting surface; a plurality of support elements that have opposing first and second surfaces that are separated by a dimension sufficient to permit air and water to flow between the roof supporting surface and the elongate batten strips when the elongate batten strips are secured to the second side of the support elements, the support elements configured to be attached to the roof supporting surface when the elongate collapsible spacer elements are extended in a substantially horizontal orientation across the roof supporting surface such that the first opposing side of the support elements is in contact with the roof supporting surface, the plurality of support elements being located between the roof supporting surface and the elongate collapsible spacer elements that are secured to the support elements on the first surface of the collapsible spacer element, the elongate batten strips attached to the second surface of the support elements such that the support elements provide a combined structure that is sufficient to support the elongate batten strips above the roof supporting surface.

DETAILED DESCRIPTION OF THE INVENTION

Figure 1:
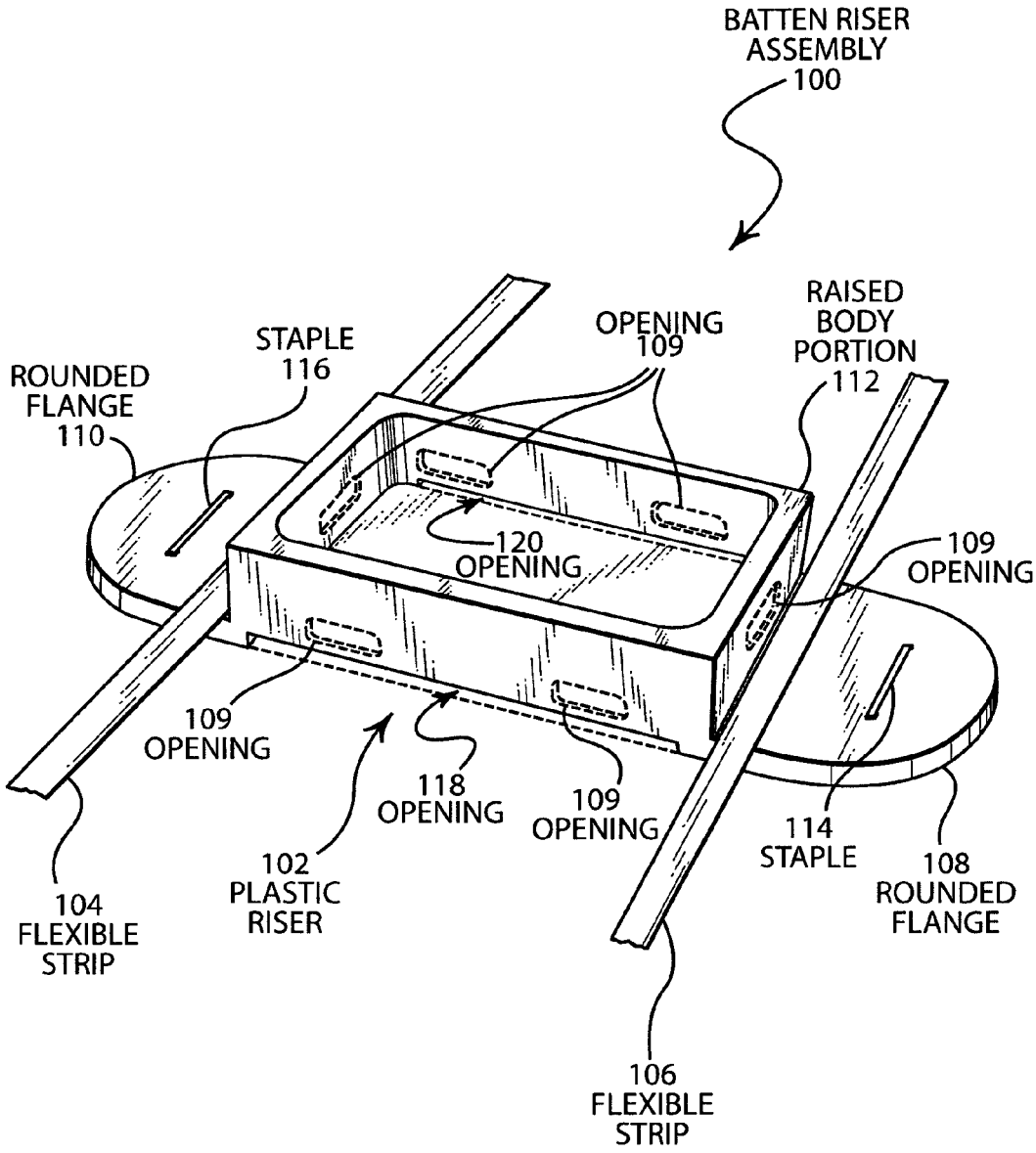
FIG. 1 is an isometric view of one embodiment of a batten riser assembly.

FIG. 1 is an isometric view of an embodiment of a batten riser assembly 100. As shown in FIG. 1, the batten riser assembly includes a plastic riser 102 and flexible strips 104, 106 that are attached to the plastic riser 102. The plastic riser 102 can be made of any type of plastic or rubberized material that is not susceptible to damage by water or any other type of waterproof material. Other types of materials can also be used such as galvanized metal or other rustproof treated metals, rubber-coated or plastic-coated materials, etc., all of which are referred to herein as a plastic riser. The plastic riser 102 also has sufficient strength to handle loads that are applied to the roof without substantially compressing. The plastic riser can be made from a single molded piece of plastic, such as an injection molded piece or an extruded piece. The plastic riser 102 can be made of plastic such as polycarbonate, PET, polypropylene, polyethylene, wood, wood fiber, rubber, treated wood, or coated material that is coated with a waterproof material. The plastic riser illustrated in FIG. 1 has rounded flanges 108, 110 that are disposed at the lateral ends and a raised body portion 112 in the center portion of the plastic riser 102. Again, the raised body portion 112 should have sufficient thickness and be made of a material that is capable of handling the loads of the roof system, including people walking on the roof system, without collapsing. The rounded flanges 108, 110 are used to fasten the plastic riser 102 directly to the felt-covered roof structure (not shown). The rounded flanges 108, 110 can be of any desired shape that is capable of shedding water. In other words, the rounded flanges 108, 110 are oriented in a substantially vertically inclined direction on the roof deck and are shaped so that water, that may penetrate between the roof tiles is not dammed and can easily flow around the rounded shaped flanges 108, 110, i.e., do not collect water. Other shapes that may be suitable include a pointed shape, an oblong shape or any other desired shape. The rounded flanges 108, 110 can also be attached to the sides of the raised body portion 112, so long as the shape of the flanges is not such that the flange could collect and dam water on the surface of the roof. The raised body portion 112 is open in the middle to allow any water that seeps into the raised body portion to flow out of the bottom of the riser 102 or through openings 118 and 120, on the sides of the raised body portion. In that way, water does not collect within the raised body portion which may cause leaks.

Of course, the flanges 108, 110 can be attached to the felt-covered roof deck in any desired fashion including nails, staples, screws, glue, contact cement, pressure-sensitive adhesive or any other desired way of attaching the riser. The raised body portion 112 could also be constructed so that there is no opening at the bottom of the raised body portion 112, and openings 109, that are formed in the walls of the raised body portion 112, would allow water to flow from the cavity created by the raised body portion 112. This alternative structure may provide additional rigidity and stability for the raised body portion 112.

FIG. 1 also illustrates flexible strips 104, 106. Flexible strips 104, 106 are attached to the rounded flanges 110, 108, respectively. The flexible strips 104, 106 can be attached by any desired means including ultrasonic welding, heat welding, various glues or adhesives, staples, screws, nails, etc. The flexible strips 104, 106 can be made of any type of plastic material or webbing and can also include fiber reinforced plastic such as fiberglass reinforced or carbon fiber reinforced plastic materials. In this case, the fiber reinforcement ensures that the flexible strips 104, 106 are sufficiently strong and do not stretch. In addition, the flexible strips 104, 106 are made of a material that is cut along a straight line so that the edge of the flexible strips 104, 106 can be used to align the batten riser assembly 100 along the roof during installation. Use of the flexible strips 104, 106 to align the batten riser assembly 100 eliminates the step of measuring and aligning the batten riser assembly 100 using chalk snap lines and other time consuming methods of marking the roof to properly align and install the batten riser assembly 100. This is explained in more detail below with respect to FIG. 5. The staples 114, 116 are placed through the raised flange 108, 110, respectively, to hold the batten riser assembly 100 in a properly aligned location on the roof surface. Of course, any desired way of attaching the plastic riser 102 to the roof can be used including nails, screws, adhesives, etc.

Figure 2:
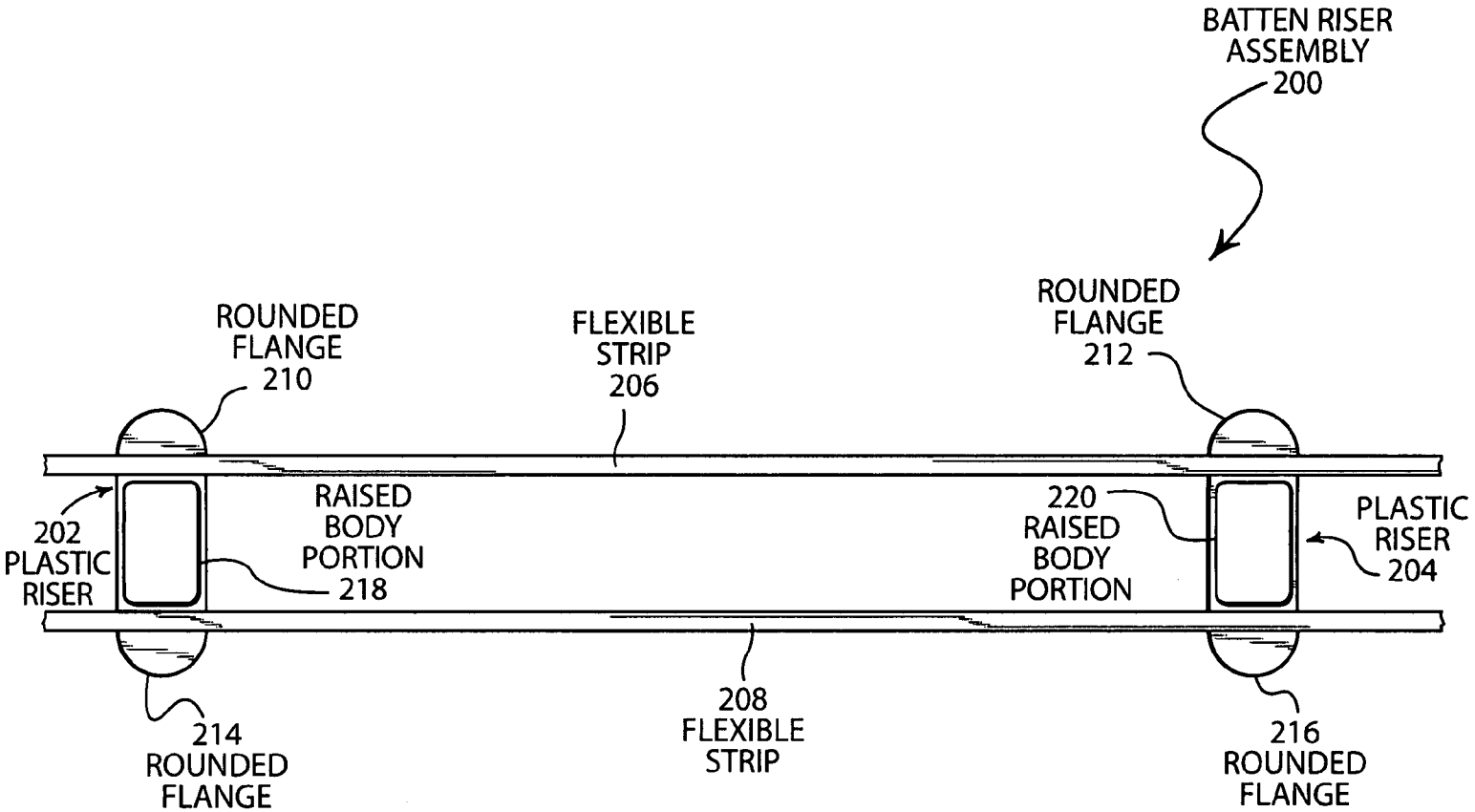
FIG. 2 is a top plan view of a batten riser assembly of the embodiment of FIG. 1.

FIG. 2 is a top view of a batten riser assembly 200. As shown in FIG. 2, plastic riser 202 and plastic riser 204 are connected by flexible strips 206, 208. The flexible strips 206, 208 form a straight line between the plastic risers 202, 204 and continue in that fashion to additional plastic risers that are spaced evenly at a predetermined distance that is in accordance with building code. For example, the plastic risers may be spaced at a distance of 12 inches which meets known code requirements. Since the flexible strips 206, 208 are cut along a straight line and form a straight line when extended along the roof surface, the flexible strips can be used to properly align the batten riser assembly 200 in the proper location on the roof without relying on the tedious process of marking the roof for proper placement of the batten riser assembly 200.

As also illustrated in FIG. 2, the plastic riser 202 has a rounded flange 210 and rounded flange 214 that rest against the waterproofing layer of the roof, which is usually a felt layer. A raised body portion 218 of the plastic riser 202 creates a space between the surface of the covered roof and the batten, which is secured to the top of the raised body portion 218. Similarly, plastic riser 204 has rounded flanges 212, 214 that rest against the felt-covered roof surface. As set forth above, these flanges are shaped in a rounded configuration to allow water to flow around plastic riser 204 and not be trapped by the plastic risers. Since the flexible strips 206, 208 are disposed in a substantially horizontal orientation along the surface of the roof, the upper rounded portion of the rounded flanges 210, 212 deflect any water flowing along the surface of the roof, i.e., prevent damming of the water.

Since the flexible strips 206, 208 are straight when laid out on a roof deck, the flexible strips can be used to properly align the batten riser assembly 200 in the proper position on the roof. For example, the location of the batten riser assemblies on the roof can be easily measured and marked along each of the side edges of the roof. One of the flexible strips, such as flexible strip 206, can be aligned with the markings along each of the side edges of the roof and the batten riser assembly 200 can then be easily and quickly attached to the roof surface. In this manner, additional measuring and placement of counter battens is eliminated which greatly speeds the installation of the roof system.

Figure 3:
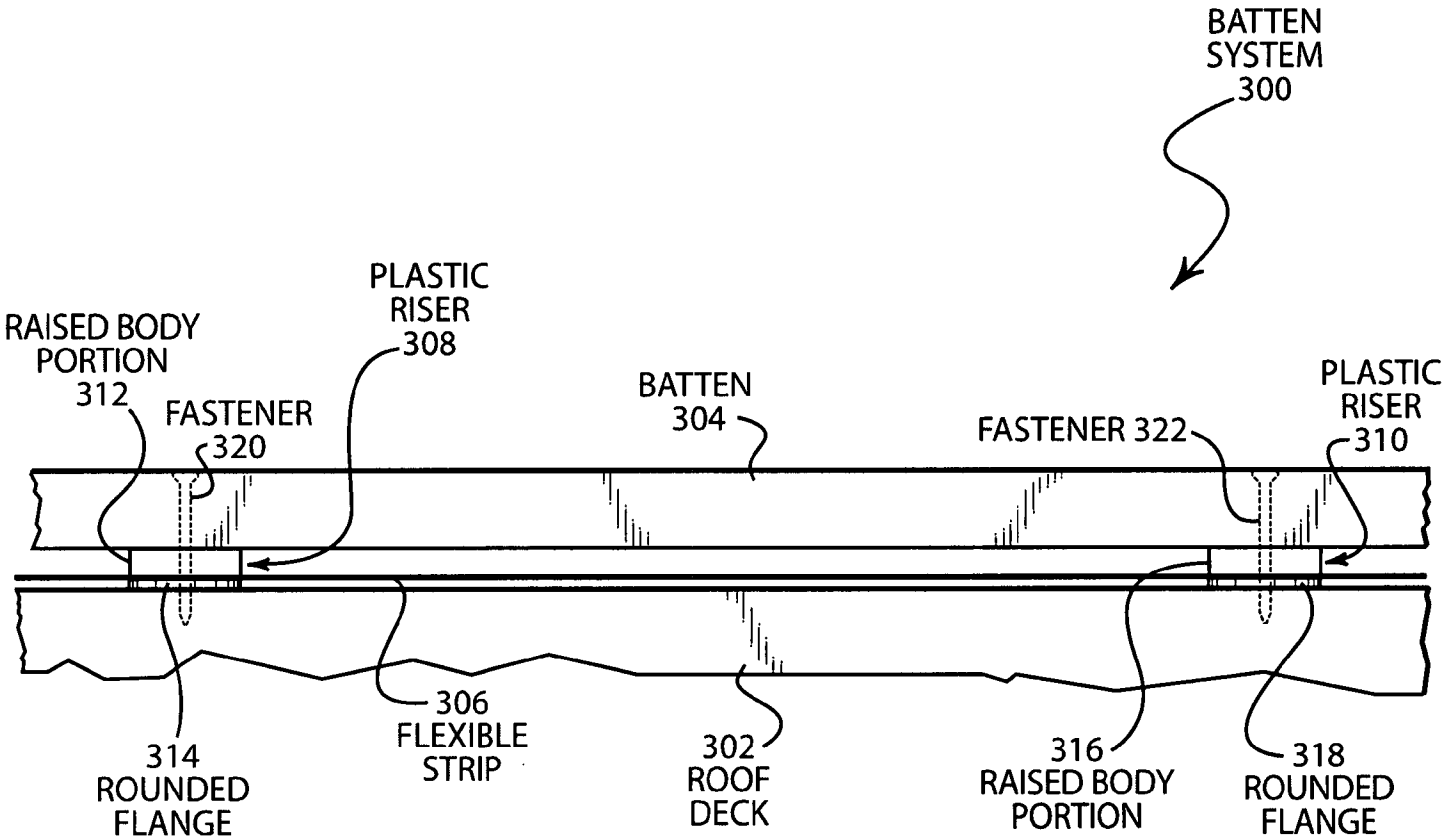
FIG. 3 is a side view of a batten system.

FIG. 3 is a side view of the batten system 300 that is installed on a roof deck 302. As shown in FIG. 3, a batten 304 secured tightly against the raised body portion 312 of plastic riser 308 and the raised body portion 316 of plastic riser 310 with screw 320 and screw 322, respectively. Of course, any desired type of fastener can be used including nails, bolts, staples, etc. in accordance with local building codes. The fasteners 320, 322 which can comprise screws, nails, staples, etc., penetrate the batten 304 and proceed through the opening in the raised body portions 312, 316 of the plastic risers 308, 310, respectively. In this fashion, the fasteners 320, 322 do not penetrate any portion of plastic risers 308, 310, respectively. Alternative embodiments may have a solid base in the plastic risers 308, 310 which would be penetrated by the fasteners 320, 322 to further secure the plastic risers 308, 310 in position. As also shown in FIG. 3, the flexible strap 306 is attached to rounded flange 314 of plastic riser 308 and rounded flange 318 of plastic riser 310.

Figure 4:
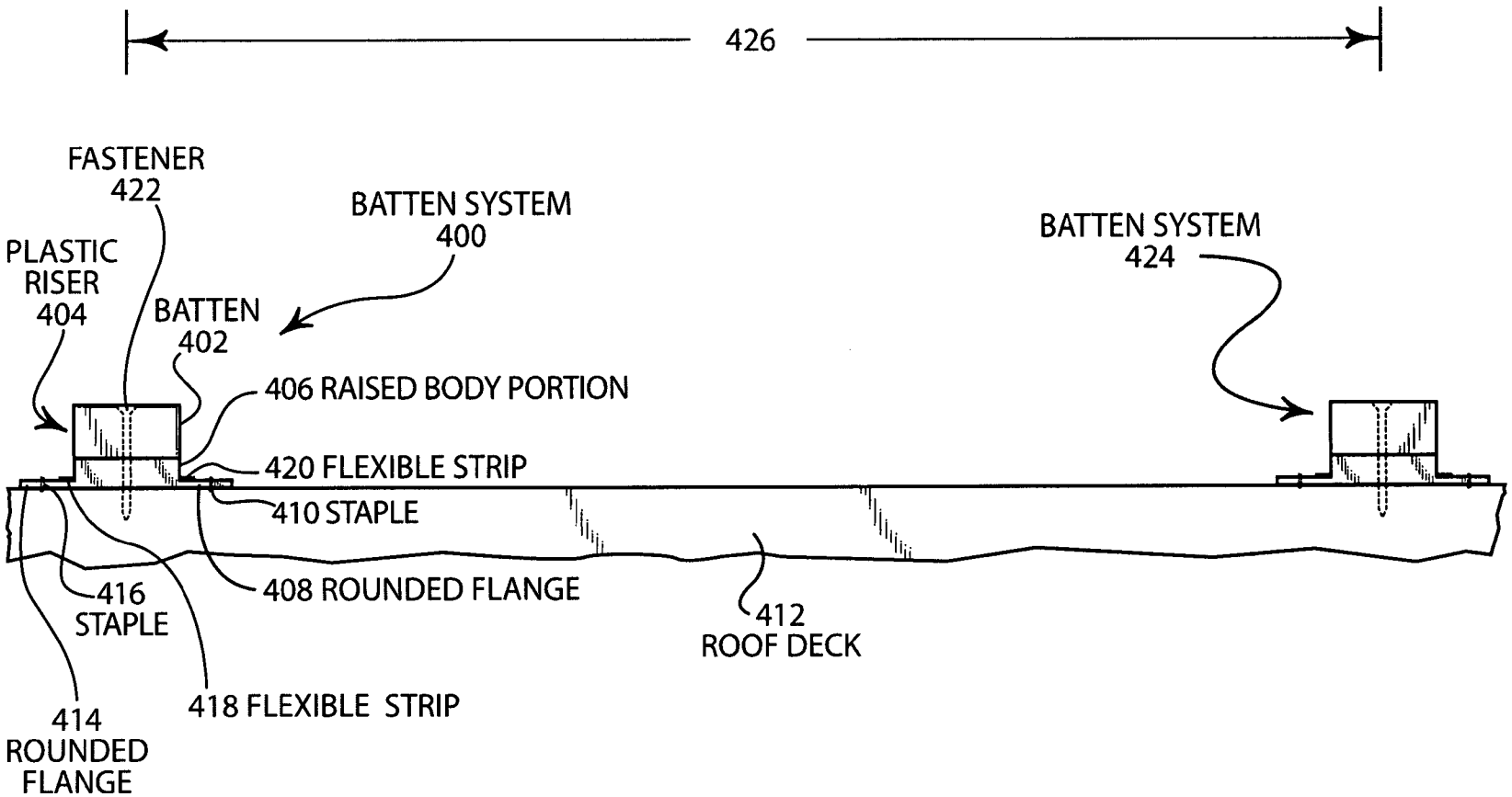
FIG. 4 is an end view of the batten system.

FIG. 4 is an end view of batten system 400 and batten system 424. As shown in FIG. 4, a batten 402 is secured to a plastic riser 404 with screw 422. Fastener 422 penetrates the batten 402, the hollow portion of the raised body portion 406 of the plastic riser 404 and the roof deck 412. Flexible straps 418, 420 connect the plastic riser 404 to additional plastic risers that are aligned in a substantially horizontal direction along the roof surface. Staples 410, 416 penetrate the rounded flanges 408, 414, respectively, and the roof deck 412 to hold the plastic riser 404 in place. A similar batten system 424 is aligned in a substantially horizontal direction on the roof surface, as shown in FIG. 4, and spaced from the batten system 400 by a distance 426 which falls within the range of acceptable overlap of the particular tile that is to be used with the batten systems.

Figure 5A:
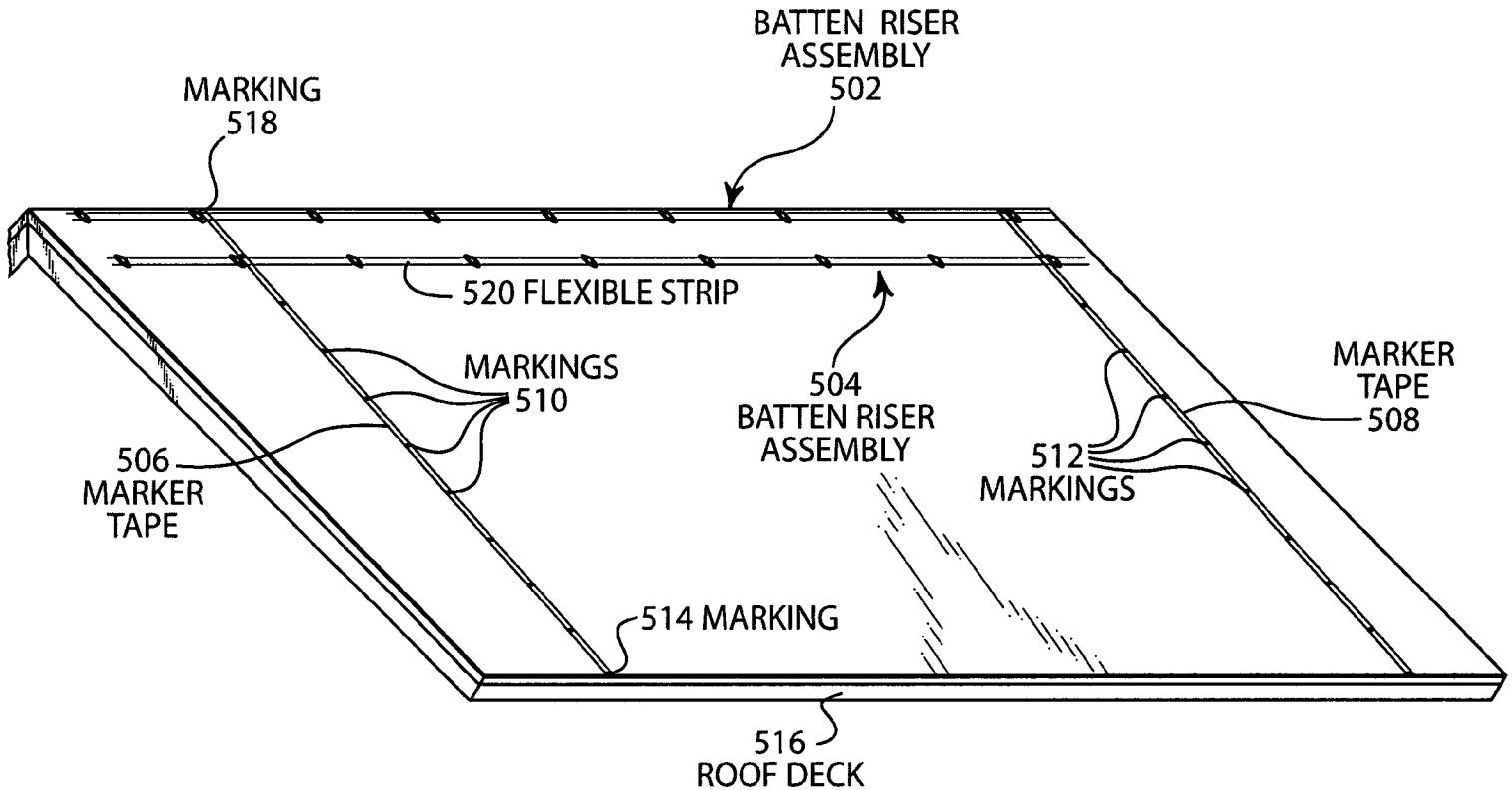
FIG. 5A is an isometric view of a system for installing the batten system of FIGS. 3 and 4.

FIG. 5A is an isometric view of a roof deck illustrating the manner in which batten riser systems can be installed. As mentioned above, the vertically-oriented spacing along the roof surface of the individual batten system, such as the spacing between batten riser assembly 502 and batten riser assembly 504, is dependent upon the size of the tile that is being installed. Various sizes of tiles have different ranges of acceptable overlap. Typically, batten system 502 and batten system 504 are spaced apart by a maximum of 14 inches. Installation can be done using standard techniques of measuring and placing markings on the roof surface. The flexible strips can then be lined up with the markings for installation. An alternative method is illustrated in FIG. 5A using marker tapes 506, 508.

As shown in FIG. 5A, marker tape 506 and marker tape 508 each have a series of markings 510, 512, respectively. The markings 510, 512 are placed at the maximum spacing (minimum overlap) of the particular type of tile that is being used. Typically, marker tapes will have markings that are spaced apart by 14 inches, which corresponds to the typical spacing for mounting tiles and provides the typical overlap. The marker tape 506 and marker tape 508 are used to align batten riser assemblies for easy installation. This is done by aligning one of the markings on the marker tape, such as marking 514 at the bottom edge of the roof deck 516 or at a location near the bottom of the roof deck. The marker tape 506 is then rotated along the surface of the roof until a marking, such as marking 518, is aligned with the peak of the roof or at a location that is a selected distance from the peak of the roof. A similar process is performed with marker tape 508. The flexible strip, such as flexible strip 520 of the batten riser assembly 504, is then aligned with the markings on the tape and attached to the roof deck 516. Since the flexible strips form a straight line, flexible strips can be aligned with the markings on marker tape 506 and marker tape 508 and have a spacing that is less than the maximum spacing allowed between the batten riser assemblies. Additionally, since the markings 510 and markings 512 are equally placed on the marker tape 506 and marker tape 508, respectively, the marker tapes 506, 508 are rotated the same amount to align the markings with the peak of the roof deck 516 or some other location. Hence, when the batten riser assemblies are aligned with the markings 510, 512, the batten riser assemblies are square with the roof deck 516, i.e., the batten riser assemblies are aligned in a substantially horizontally-oriented configuration. Also, the roof does not have to be measured and marked since the flexible strip is used to align the batten riser assembly with the markings on the marker tape.

Figure 5B:
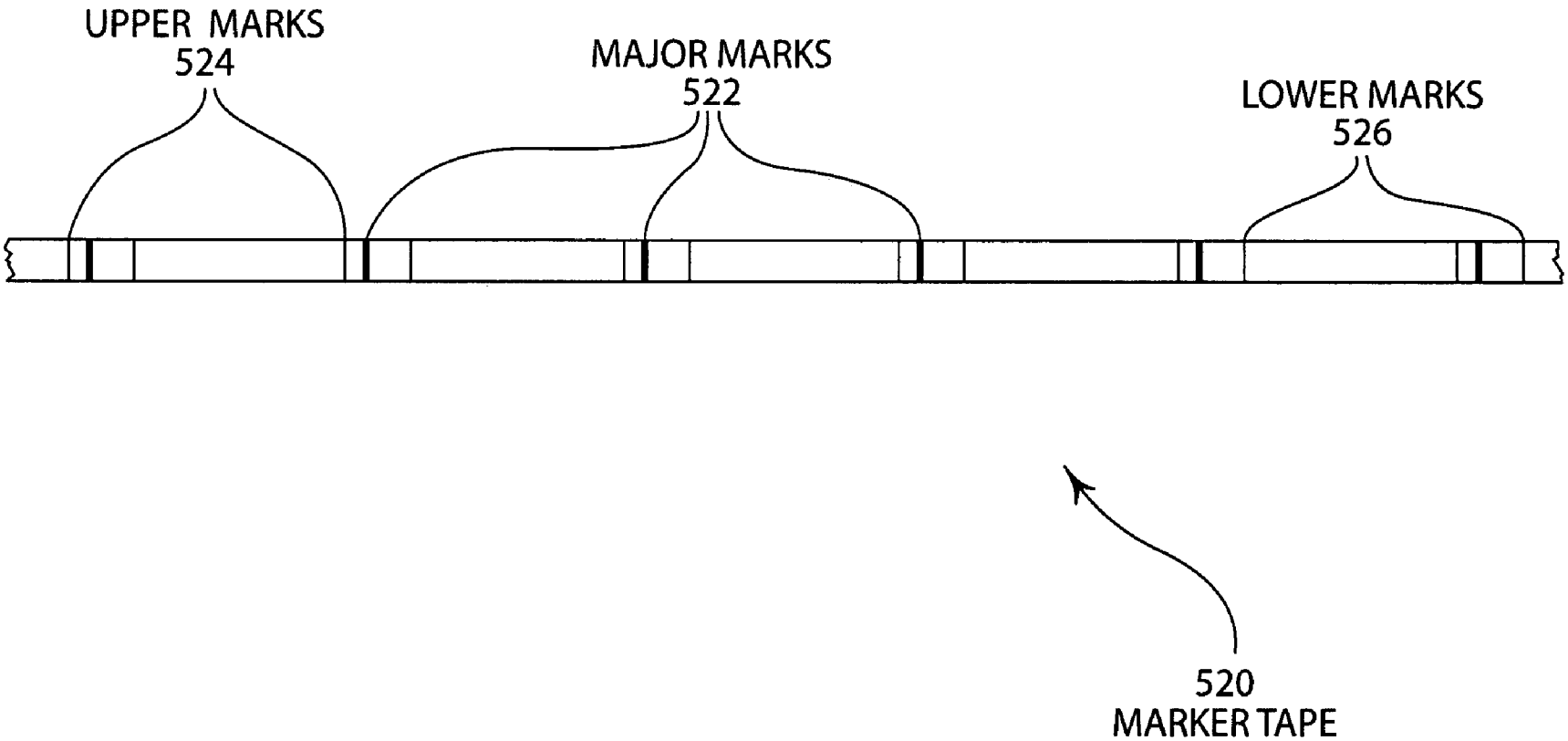
FIG. 5B is a top view of an alternative marker tape.

FIG. 5B is an alternative embodiment of a marker tape 520. As shown in FIG. 5B, major marks 522 are spaced equally along the length of the marker tape 520. For example, 17 inch tiles of the major marks 522 may be spaced 14 inches along the length of the tape to insure a 3 inch overlap of the tile. Illustrated in FIG. 5A, it may be desirable to have the top batten riser assembly 502 spaced down from the ridge of the roof. In that regard, upper mark 524 is placed on the marker tape 520 to provide a spacing between the roof ridge and the location of the batten riser assembly 502 which is placed on a major mark 522. For example, upper mark 524 may be placed 1.5 inches above the major mark 522. Similarly, the lowest batten on the roof deck 516 of FIG. 5A may be placed a predetermined distance from the edge of the roof deck 516. Lower mark 526 provides the proper spacing between the major mark 522 and the edge of the roof deck which is aligned with the lower mark 526. For example, lower mark 526 may be spaced from the major marks 522 by three inches to provide a three inch spacing between the edge of the roof deck 516 (FIG. 5A) and the batten riser assembly. Placement of the lowest batten riser assembly at three inches above the roof edge provides the proper amount of overlap and spacing of the tile along the edge of the roof deck 516 (FIG. 5A).

In operation, the marker tape 520 of FIG. 5B is used as follows. Marker tape 520 is placed on the roof deck 516 and a lower mark 526 is aligned with the lower edge of the roof deck 516. The tape is then laid out across the roof deck and rotated until an upper mark 524 is aligned with the ridge of the roof. Another marker tape is laid out on the roof deck in the same manner and spaced apart from the first marker tape. The flexible strips of the batten riser assembly 502 are then aligned with the major marks 522 and attached to the roof with the proper spacing and placement on the roof. This procedure eliminates the steps of measuring and marking the proper location of the upper and lower batten riser assemblies.

The advantages of using the marker tapes and straight flexible strips are that no calculations have to be made as to the spacing between the batten riser assemblies and no chalk lines have to be snapped to mark the placement of the batten riser assemblies since the flexible strips are straight and provide the proper alignment of the risers without the necessity of marking the placement of the risers. These two advantages allow a roofer to quickly and easily install the batten riser assemblies in a fashion that substantially reduces the effort and time required for installation of the batten riser assemblies. Because the markings on the marker tapes are not greater than the maximum distance between batten riser assemblies (minimum overlap of tiles), rotation of the marker tape on the roof surface simply reduces the spacing between the batten riser assemblies. The use of this technique does not allow the batten riser assemblies to exceed the maximum spacing between the batten riser assemblies.

Figure 6:
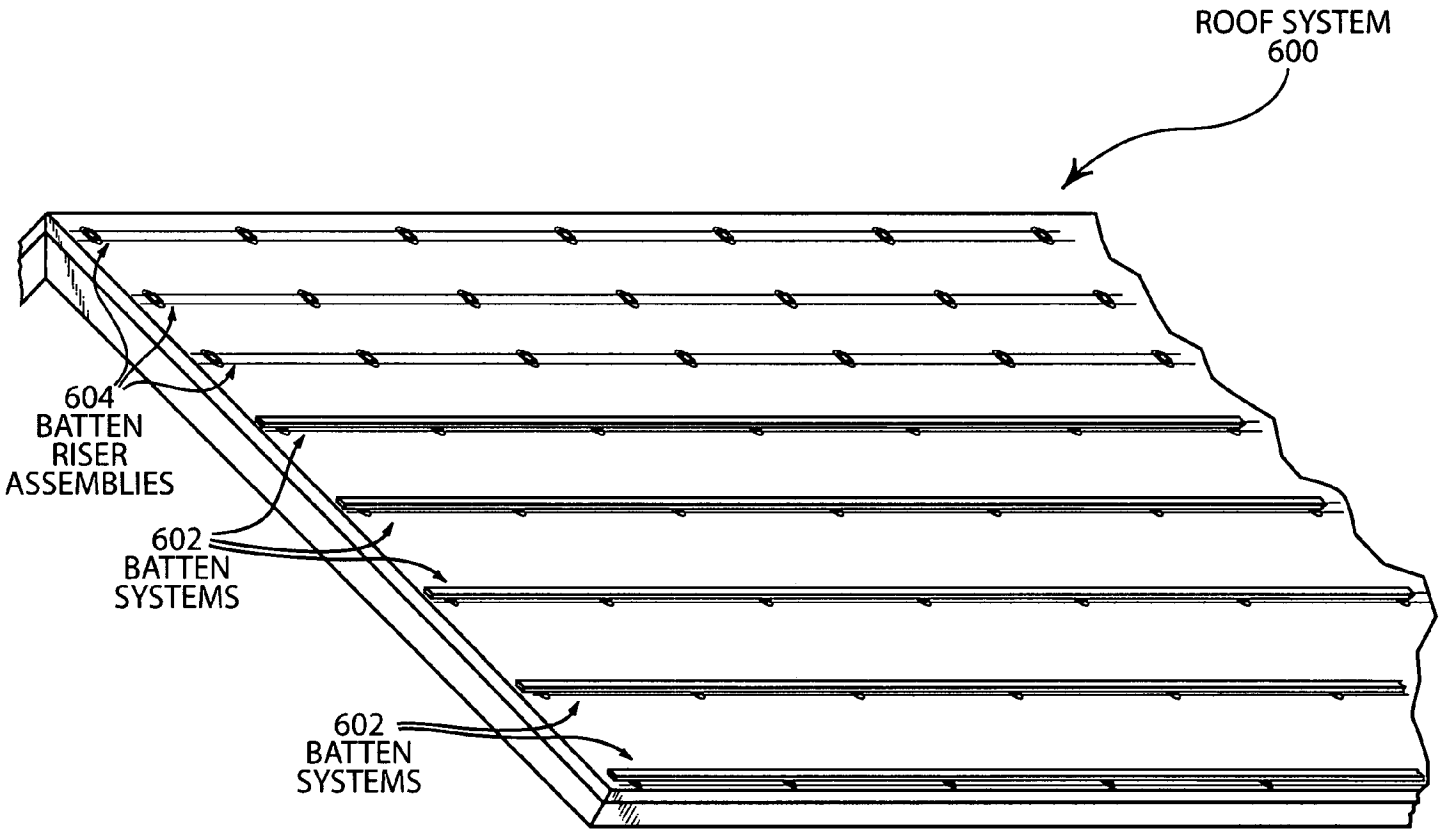
FIG. 6 is an isometric view of a partially installed batten system on a roof structure.

FIG. 6 is an illustration of a roof system 600. The roof system illustrated in FIG. 6 shows a plurality of batten systems 602 that have been installed over a plurality of batten riser assemblies 604. FIG. 6 illustrates a plurality of batten riser assemblies 604 that do not yet have battens installed. As can be seen from FIG. 6, the batten riser assemblies are installed square with the roof and are parallel with one another. The square and parallel installation can be achieved in a simple and easy fashion using the marker tape as illustrated and described with respect to FIG. 5. The installation illustrated in FIG. 6 can also be achieved by measuring and marking the roof system as described above. As shown in FIG. 6, the top batten riser is installed slightly below the roof peak to accommodate a series of peak shingles that overlap shingles on both sides of the roof. Hence, it may be desirable to have additional marks on the marker tape that are placed above the regular marks by a distance that allows for spacing between the peak and/or the edge of the roof and the placement of the top and bottom batten riser assemblies. In this fashion, the peak of the roof and/or the edge of the roof can be aligned with these additional marks so that the batten riser system 604 can be placed in a position that is spaced from the roof peak or lower roof edge. This distance is dependent upon the type of tile and the manner in which it is installed over the batten system.

Figure 7:
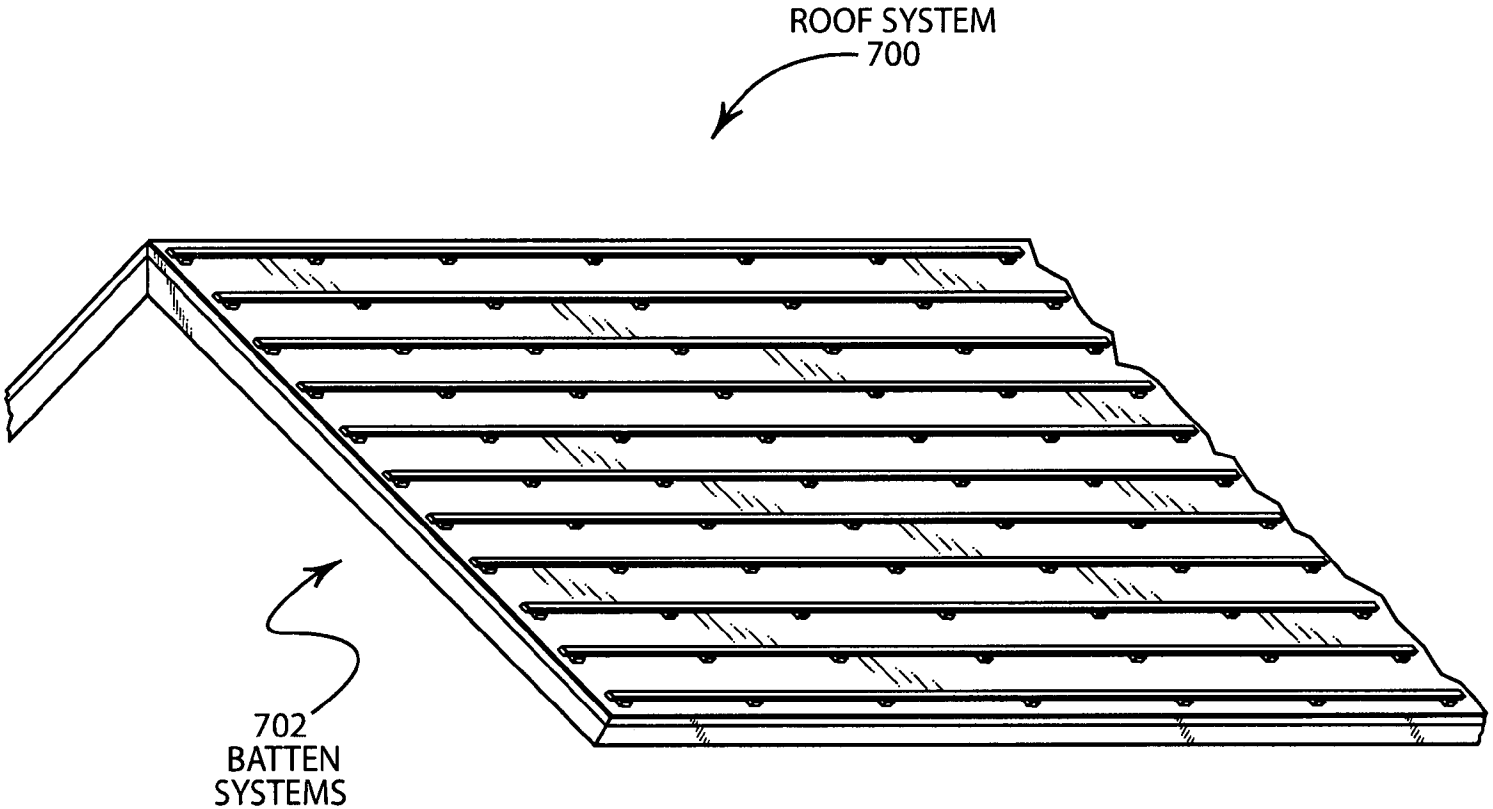
FIG. 7 is an isometric view of a fully installed batten system on a roof structure.

FIG. 7 is an illustration of a roof system 700 that includes a series of fully installed batten systems 702. Again, the batten systems are aligned in a square and parallel fashion in a substantially horizontal orientation for a properly aligned roof system. The roof system 700 illustrated in FIG. 7 is ready for installation of tiles.

Figure 8:
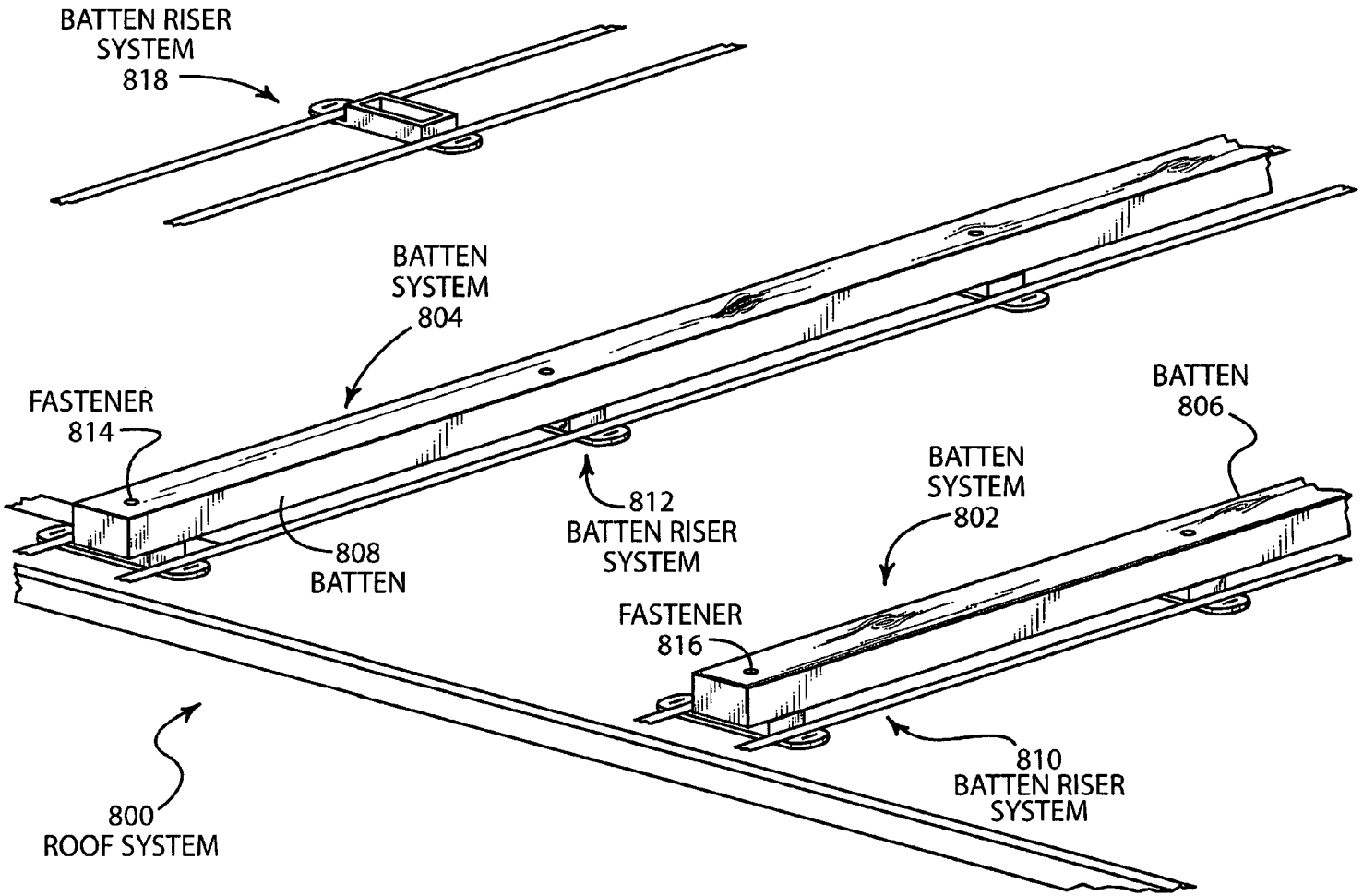
FIG. 8 is a close-up view of a batten system installed on a roof structure.

FIG. 8 is a close-up view of a roof system 800. Batten system 802 and batten system 804 have battens 806, 808 that are installed over the batten riser systems 810, 812, respectively. As can be seen in FIG. 8, the screws, such as fastener 814 and fastener 816, which can comprise screws, nails, staples, etc., secure the battens 806, 808 to the batten riser systems 810, 812, respectively. Batten riser system 818 is shown without a batten installed, illustrating the manner in which the batten riser system 810 is installed on the roof deck.

Figure 9:
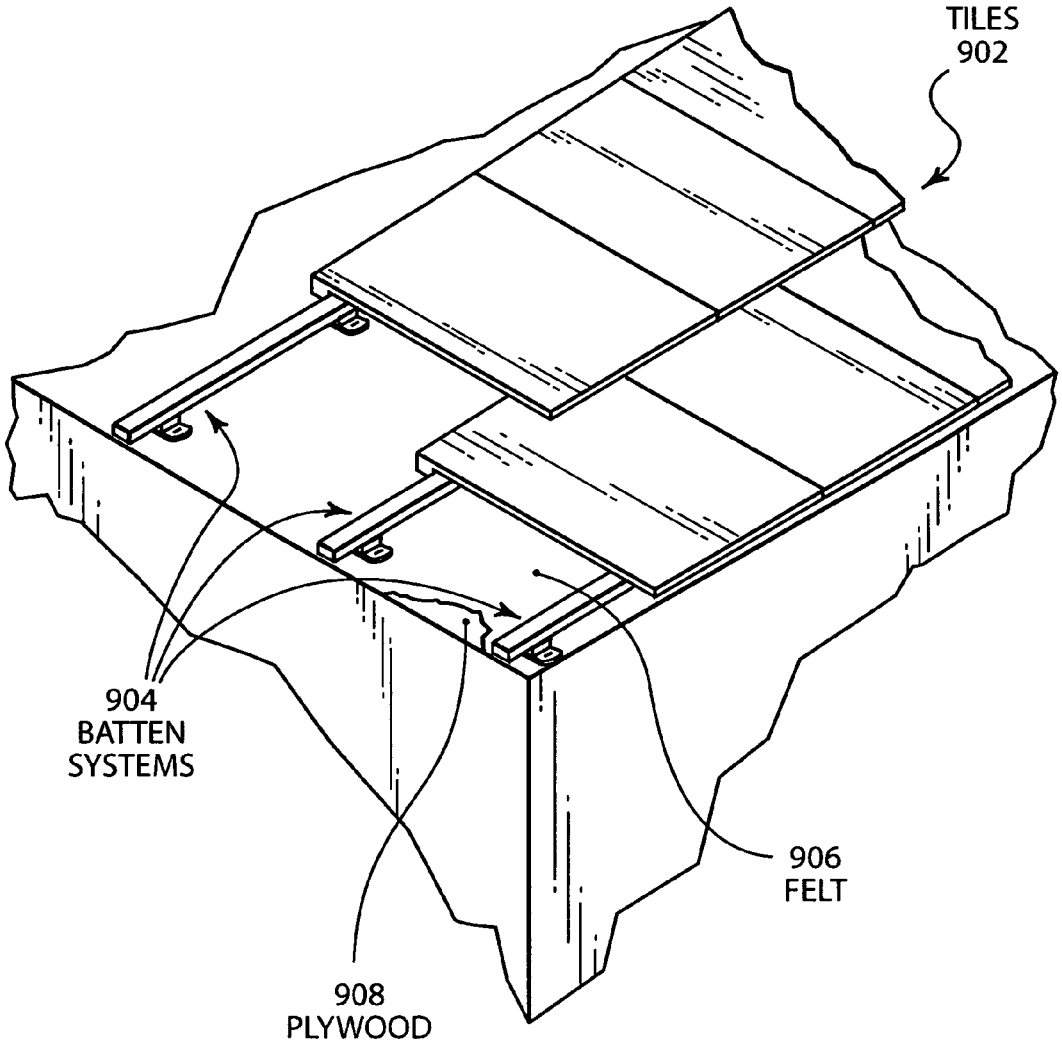
FIG. 9 is an isometric view of an installed batten system with roof tiles partially installed on the batten system.

FIG. 9 is a isometric view illustrating the manner in which tiles 902 are installed on the batten system 904. As shown in FIG. 9, the tiles 902 overlap by a distance that should not be less than a predetermined amount. The markings 510, 512 on the marker tape 506, 508, respectively (FIG. 5), ensure that the overlap illustrated in FIG. 9 is not less than the predetermined amount of overlap required for a particular tile. FIG. 9 also illustrates the felt 906 and plywood decking 908 of the roof system.

Figure 10:
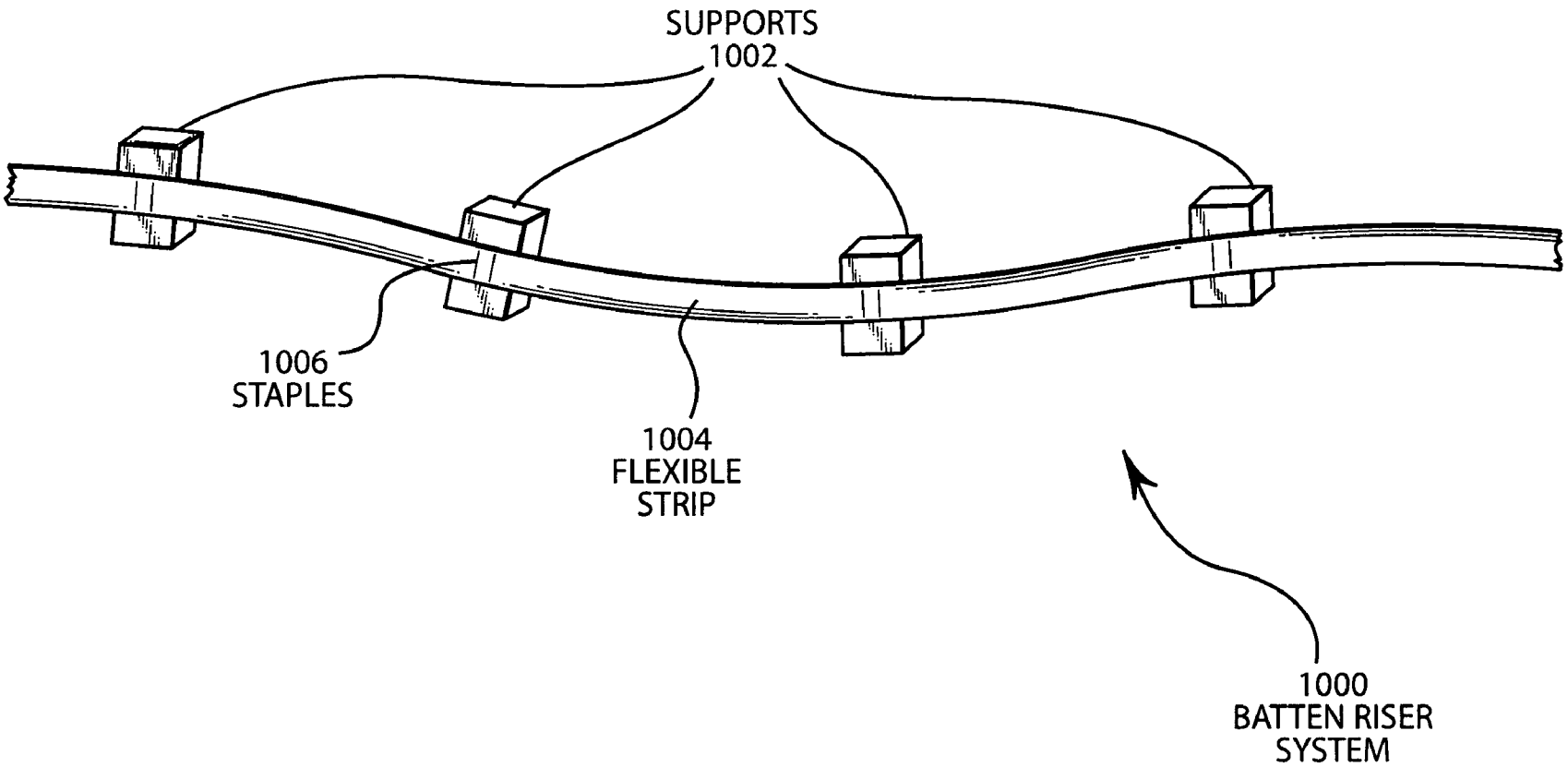
FIG. 10 is a schematic illustration of another embodiment of a batten riser system.

FIG. 10 is an isometric view of another embodiment of a batten riser system 1000. As shown in FIG. 10, there are series of supports 1002 that can be constructed of a waterproof type material, such as rubber, plastic or other materials. Flexible strip 1004 can be attached to the supports 1002 in any desired manner such as stapling, using staples 1006, screwing, gluing, nailing, bolting, etc. The flexible strip 1004 was cut in a straight line so that the strip provides a straight edge for alignment with a marker tape, or measured points, on the roof surface. Flexible strip 1004 may be made of a web material as disclosed above. As also disclosed above, the flexible strip 1004 can comprise any type of material that is capable of holding supports 1002 in alignment and spaced by a predetermined distance. For example, rope, string, tape or other materials that are sufficiently strong and capable of holding and aligning supports 1002 can be used.

Figure 11:
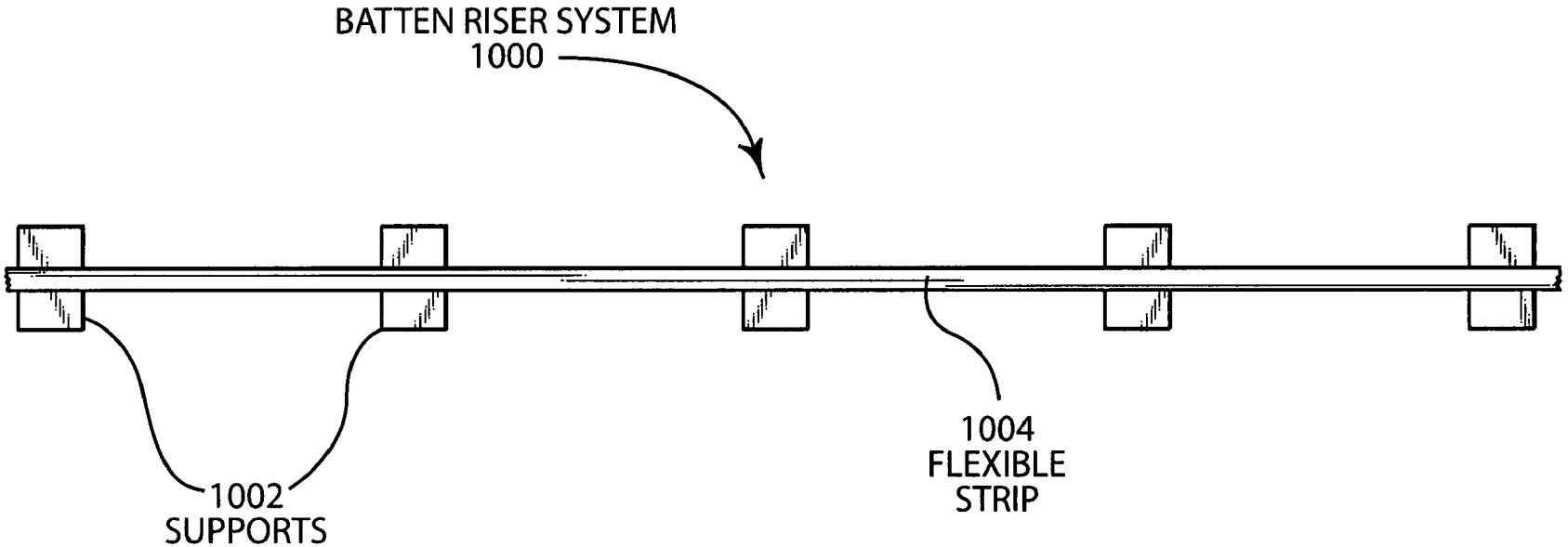
FIG. 11 is a plan view of an embodiment of FIG. 10.

FIG. 11 is a top view of an embodiment of FIG. 10. As shown in FIG. 11, the batten riser system 1000 is laid out in a substantially straight line using the flexible strip 1004 to hold the supports 1002 in substantially straight alignment and spaced by a predetermined amount since the flexible strip is substantially resistant to stretching.

Figure 12:
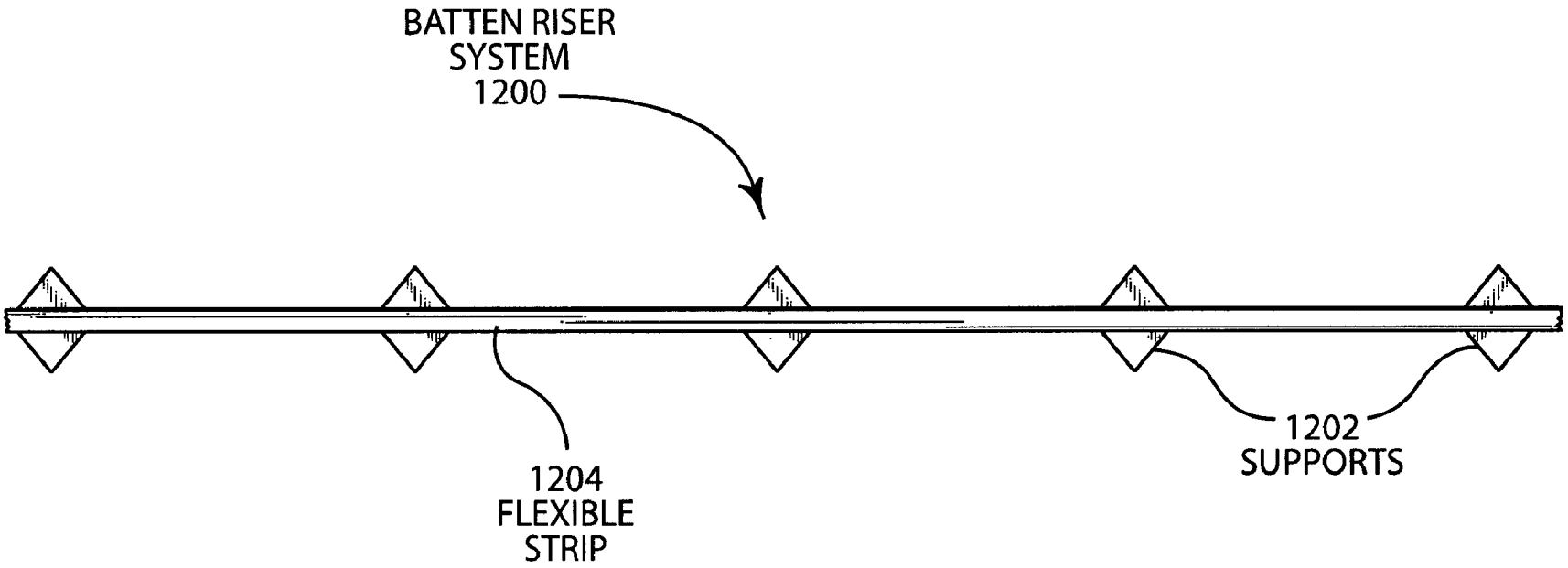
FIG. 12 illustrates another embodiment of a batten riser system.

FIG. 12 is a top view of another embodiment of a batten riser system 1200. As shown in FIG. 12, the supports 1202 are installed in a diagonal orientation with respect to the flexible strip 1204. As such, the supports 1202 are pointed in a vertical orientation so that water does not collect on any of the surfaces of the supports 1202. Similarly, the flexible strip 1204 can be made of any desired type of material such as the materials described with respect to flexible strip 1004.

The present invention therefore provides a unique batten riser system that can be used to prolong the life of tile roofs and substantially reduce the time of installation. The system can be used in conjunction with marker tape to further reduce the time of installation. The batten riser system provides a system for ensuring compliance with building codes for the installation of roof systems and is substantially less expensive than existing counter-batten systems.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A roofing system that is attached to a roof deck comprising:

battens that are attached to said roof deck; and, batten risers disposed between said battens and said roof deck that support said battens on said roof deck comprising:

at least one flexible strip that is collapsible and that has sufficient flexibility to allow said flexible strip to be folded; and a plurality of risers substantially evenly spaced and attached to said flexible strip, each riser of said plurality of risers constructed from a substantially waterproof material comprising:

at least one flange that extends outwardly from said riser along a bottom portion of said riser adjacent said roof deck that provides an area that is sufficiently large to mechanically attach said flange to said roof deck;

a raised body portion having a surface that supports said battens and that provides a gap between said battens and said roof deck.

2. The batten riser assembly of claim 1 wherein said at least one flange is attached to said roof deck in a vertically disposed orientation and has a rounded shape that does not substantially dam water.

3. The batten riser assembly of claim 1 wherein said raised body portion has walls that form a rectangular shape and that form a gap between said walls and said roof deck that is disposed in a horizontal direction.

4. The batten riser assembly of claim 1 wherein said at least one flexible strip is made from plastic webbing that is reinforced with fibers that have a tensile strength sufficient to substantially minimize stretching along the length of the strip.

5. A roof batten riser system that is attached to a roof supporting surface comprising:

elongate collapsible webbing that has opposing first and second surfaces;

a plurality of risers that are attached to said first surface of collapsible webbing, said risers constructed of a waterproof material comprising:

a sidewall that extends away from said roof supporting surface by a dimension sufficient to permit air and water to flow along said roof supporting surface;

an annular ring formed from a top surface of said sidewall that is flat and that provides a surface that is adapted to support a batten;

at least one flange that extends outwardly from said sidewall along a second side of said risers that is adjacent to said roof supporting surface, said flange having a surface area disposed on said roof supporting surface that is sufficiently large to allow said risers to be mechanically attached to said roof surface such that said elongate collapsible webbing is extended in a substantially horizontal orientation across said roof supporting surface and said risers are disposed substantially evenly along said collapsible webbing;

elongate batten strips disposed on said annular ring formed from said top surface of said sidewall and attached to said roof supporting surface, said risers providing a combined structure that is sufficient to support said elongate batten strips above said roof supporting surface.

6. The roof batten riser system of claim 5 wherein said risers are composed of plastic.

7. The roof batten riser system of claim 5 wherein said risers are composed of extruded polymer.

8. The roof batten riser system of claim 5 wherein said risers are composed of an injection molded polymer.

9. The roof batten riser system of claim 5 wherein said elongate collapsible spacer element is composed of a single polymer strip.

10. The roof batten riser system of claim 5 wherein said elongate collapsible webbing is composed of two polymer strips.

11. The roof batten riser system of claim 5 wherein said elongate collapsible webbing is composed of multiple polymer strips.

12. The roof batten riser system as of claim 5 wherein said elongate collapsible spacer element is composed of a single polymer film.

13. The roof batten riser system of claim 5 wherein said elongate collapsible spacer element is composed of two polymer films.

14. The roof batten riser system of claim 5 wherein said elongate collapsible spacer element is composed of multiple polymer films.

15. The roof batten riser system of claim 5 wherein said elongate collapsible webbing is attached to said risers by a mechanical element.

16. The roof batten riser system of claim 5 wherein said elongate collapsible spacer element is attached to said plurality of spacer elements by an adhesive.

17. The roof batten riser system of claim 5 wherein said plurality of spacer elements are attached to said elongate collapsible spacer element using ultrasonic welding.

18. The roof batten riser system of claim 5 wherein said plurality of spacer elements are attached to said elongate collapsible spacer element using heat welding.

19. The roof batten riser system of claim 5 wherein said elongate collapsible webbing has a tensile strength sufficient to minimize stretching along the length of said elongate collapsible webbing and is made of a composition such that said elongate collapsible webbing can be cut to any desired length.

* * * * *